US005854181A

United States Patent [19]

Na

[11] Patent Number: 5,854,181

[45] Date of Patent: Dec. 29, 1998

[54] AUTOMATIC TRANSMISSION OIL COMPOSITION

[75] Inventor: Gee Sik Na, Cheonju-si, Rep. of Korea

[73] Assignee: Hyundai Motor Company, Seoul, Rep. of Korea

[21] Appl. No.: 979,166

[22] Filed: Nov. 26, 1997

[30] Foreign Application Priority Data

Nov. 29, 1996 [KR] Rep. of Korea ..... 1996-59965

[51] Int. Cl.[6] ..... C10M 125/10; C10M 141/02

[52] U.S. Cl. ..... 508/180; 508/479

[58] Field of Search ..... 508/180, 479

[56] References Cited

U.S. PATENT DOCUMENTS

| | | | |
|---|---|---|---|
| Re. 31,611 | 6/1984 | Wainwright et al. | 508/180 |
| 3,152,989 | 10/1964 | Versteeg et al. | 508/180 |
| 3,457,286 | 7/1969 | Dexter et al. | 508/479 |
| 4,699,939 | 10/1987 | Orban et al. | 508/479 |
| 5,456,848 | 10/1995 | Nader et al. | 508/180 |

*Primary Examiner*—Jacqueline V. Howard

[57] ABSTRACT

This invention relates to an automatic transmission oil composition and more particularly, to an automatic transmission oil composition to improve its physical properties such as low-temperature pour property, heat-oxidative stability and friction-adjusting capacity by adding some calcium salicylate compound, an detergent dispersant, to a common lubricant oil.

4 Claims, No Drawings

AUTOMATIC TRANSMISSION OIL COMPOSITION

BACKGROUND OF THE INVENTION

1. Field of the Invention

This invention relates to an automatic transmission oil composition and more particularly, to an automatic transmission oil composition to improve its physical properties such as low-temperature pour property, heat-oxidative stability and friction-adjusting capacity by adding some calcium salicylate compound, a detergent dispersant, to a common lubricant oil.

2. Description of the Prior Art

Recently, the number of drivers among women and elderly people has been drastically increasing since an automobile becomes life necessities. To cope with this trends, various convenient apparatuses of an automobile for easy driving and handling have been under active development. Among them, an automatic transmission is one of the basic options for the automobile irrespective of its high price, since no clutch operation for higher performance is required.

Unlike a manual transmission to select the ratio of a power transmission gear after separating the engine power by contacting with clutch plate, an automatic transmission controls its rotation speed by selecting an input axis, being rotated by dynamic oil pressure with a torque converter rotated in line with the engine rotation, a wet-type multi-disc clutch and a planetary gear operated by oil pressure.

In this context, as for an oil used for the automatic transmission, being different from the conventional manual transmission oil which requires simply a role of lubricant oil, its antioxidative stability, antiabrasiveness and friction characteristics in a wet-type clutch should be considered in a comprehensive manner.

In general, the automatic transmission oil is manufactured in such a manner that a common lubricant oil is mixed with some antioxidant, detergent dispersant, antiabrasive agent, agent for adjusting a friction index, defoaming agent, viscosity index improver and colorant in a selected ratio. In particular, the currently available agent for adjusting friction index includes some sulfonic acid compound such as calcium sulfonate, barium sulfonate and magnesium sulfonate, or calcium/barium/magnesium phenate compounds. On the one hand, these compounds are highly effective in increasing the friction index of a wet-type friction clutch but on the other hand, they serve to increase the viscosity of an automatic transmission oil, thus lowering its low-temperature property.

SUMMARY OF THE INVENTION

To overcome the problems associated with the conventional automatic transmission oil, an object of this invention is to provide an automatic transmission oil having excellent properties such as low-temperature pour property, heat-oxidative stability and friction-adjusting capacity including better friction index of a wet-type friction clutch, by adding some calcium salicylate compound, a detergent dispersant, to a common lubricant oil.

DETAILED DESCRIPTION OF THE INVENTION

This invention relates to an automatic transmission oil comprising the addition of an antioxidant, detergent dispersant, antiabrasive agent, anticorrosive agent, agent for adjusting a friction index, defoaming agent, viscosity index improver and colorant to a common lubricant oil, wherein one or more compounds selected from the following formula 1 and 2 as the detergent dispersant is/are mixed with a compound expressed by formula 3 and the content ratio in the range of 0.01~5.0 wt %.

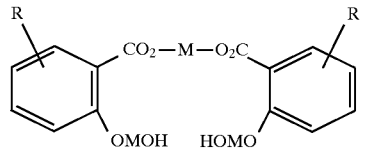

(1)

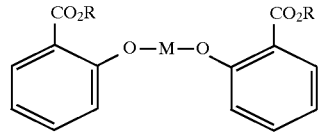

(2)

$$MCO_3M(OH)_2 \quad (3)$$

Wherein;

R is a saturated or unsaturated $C_8$~$C_{100}$ alkyl group;

M is a calcium atom.

This invention is explained in more detail as set forth hereunder.

This invention relates to an automatic transmission oil composition comprising the addition of one or more compounds selected from the following formula 1 and 2 as the detergent dispersant to a compound expressed by the formula 3. Therefore, the composition of this invention has excellent physical properties such as low-temperature pour property, heat-oxidative stability and friction-adjusting capacity.

According to the automatic transmission oil of this invention, it is noted that when the content of the detergent dispersant, from a mixture consisting of one or more compounds selected from two compounds of the formula 1 and 2 and one compound of the formula 3, increases, the enhanced viscosity contributes to better high-temperature property. However, if the composition has less ratio of the detergent dispersant, the reduced viscosity of the automatic transmission oil leads to better low-temperature property.

In consideration of the above points, this invention is characterized in that by mixing one or more compounds selected from two compounds of the formula 1 and 2 with one compound of the formula 3, the detergent dispersant is contained in the range of 0.01~5.0 wt % to the total common lubricant oil, preferably in the range of 0.1~2.0 wt %. If its content is less than 0.01 wt %, the friction-adjusting function is insufficient and in case of exceeding 5.0 wt %, the friction index may be changed since the friction-adjusting agent contained in a common automatic transmission oil is degraded and piled in some crevices of friction materials of a wet-type friction clutch.

Some compounds belonging to the formula 1 in more detail include calcium 2-methylolalkylbenzoate, magnesium 2-methylolalkylbenzoate and barium 2-methylolalkylbenzoate. Some compounds belonging to the formula 2 in more detail include calcium alkylsalicylate, magnesium alkylsalicylate and barium alkylsalicylate.

Further, some compounds belonging to the formula 3 in more detail include anhydrous calcium carbonate, anhydrous magnesium carbonate and anhydrous barium carbonate.

Meantime, the automatic transmission oil of this invention comprises the addition of an antioxidant, detergent dispersant, antiabrasive agent, anticorrosive agent, agent for adjusting a friction index, defoaming agent, viscosity index improver and colorant to a common lubricant oil. Further, any types of common lubricant oils may be employed for the composition of this invention and it is more preferred to use mineral oil.

As such, the automatic transmission oil manufactured by the addition of such compounds as a detergent dispersant has a similar friction index of a wet-type friction clutch or better, compared to that of the conventional automatic transmission oil containing magnesium sulfonate or magnesium phenate as a detergent dispersant, when measured.

Further, the automatic transmission oil composition of this invention has better oxidative stability than the conventional automatic transmission oil, since the total acid value in the former was increased by 0.15 and 1.01 after the lapse of about 24 hours and 72 hours respectively, while the latter showed an increase of 0.3~0.4 and 2.4~3.0 after the lapse of about 24 hours and 72 hours, respectively, under the conditions that rotation rate of motor: 1300±15 rpm and temperature of bath: 165.5° C.

This invention is explained in more detail as set forth hereunder but is not limited by the following Examples.

EXAMPLES 1~4 AND COMPARATIVE EXAMPLES 1~4

The automatic transmission oil was manufactured in the following table as described in the contents and compositions.

Various test conditions were described in the following tables 2 and 3.

[Evaluation method]

1. Friction

Relevant specification: JASO M349-95 (test method for anti-shuddering property of automatic transmission oil)

TABLE 2

| Classification | Test conditions for friction | | |
|---|---|---|---|
| | Break-in | Durability | Measurement test |
| Flow rate(ml) | 100 | 100 | 100 |
| Oil temp. (°C.) | room temp.~80 | 100 | 40 |
| Stress (kgf/cm$^2$) | 10 | 10 | 20 |
| Rotation rate (mm/s) | 719 | 719 | 6,180 |
| Hour (h) | 1 | 20,30 | — |

2. Low-temperature viscosity

This test was measured by ASTM D2983 [Apparent Viscosity of General at Low Temperature Using the Brookfield Viscometer].

3. Oxidative stability

This test was measured by the method of KS M 2121 [oxidation stability for lubricant oil].

TABLE 1

| Composition (wt %) | Example | | | | Comparative Example | | | |
|---|---|---|---|---|---|---|---|---|
| | 1 | 2 | 3 | 4 | 1 | 2 | 3 | 4 |
| Mineral oil | 86.6 | 86.5 | 85.6 | 83.9 | 89.4 | 89.5 | 89.4 | 89.1 |
| Calcium 2-methylol alkyl benzoate[1)] | — | 0.05 | — | 1.0 | | | | |
| Calcium alkyl salicylate[2)] | 0.005 | — | 1.0 | 2.0 | | | | |
| Calcium carbonate[3)] | 0.005 | 0.05 | 1.0 | 2.0 | 0.2 | — | — | 0.5 |
| Magnesium sulfonate | — | — | — | — | — | 0.1 | — | — |
| Magnesium phenate | — | — | — | — | — | — | 0.2 | — |
| Diphenylamine | 3.0 | 3.0 | 3.0 | 3.0 | 3.0 | 3.0 | 3.0 | 3.0 |
| Coharkacid imide | 2.5 | 2.5 | 1.5 | 0.1 | 1.5 | 1.5 | 1.5 | 1.5 |
| Tricredyl phosphate | 0.6 | 0.6 | 0.6 | 0.6 | 0.6 | 0.6 | 0.6 | 0.6 |
| Benzotriazol | 0.02 | 0.02 | 0.02 | 0.02 | 0.02 | 0.02 | 0.02 | 0.02 |
| Cetylamine | 0.6 | 0.6 | 0.6 | 0.6 | 0.6 | 0.6 | 0.6 | 0.6 |
| Dimethylpolysalikyl acid | 0.002 | 0.002 | 0.002 | 0.002 | 0.002 | 0.002 | 0.002 | 0.002 |
| Polymetacrylate | 6.668 | 6.678 | 6.678 | 6.678 | 4.678 | 4.678 | 4.678 | 4.678 |

1) 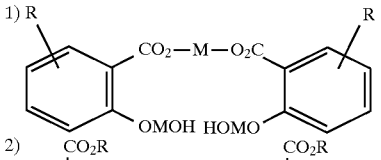

2) 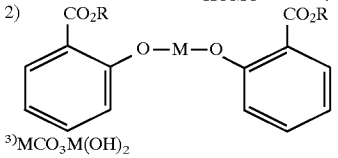

3) $MCO_3M(OH)_2$

Wherein, R is a saturated or unsaturated $C_8$~$C_{100}$ alkyl group; M is calcium atom.

Test Example

As for the automatic transmission oil manufactured in the procedures as described in the Examples 1~4 and Comparative Examples 1~4, its physical properties such as friction, low-temperature viscosity and oxidative stability were measured and the results were shown in the following table 4.

Hence, the friction was measured by a single plate friction tester (Shinko, Japan), while the oxidative stability was measured by lubricant oil-oxidative stability tester (KS M 2121) for an internal-combustion engine.

TABLE 3

| Test conditions for oxidative stability | |
|---|---|
| Oil temp. (°C.) | 165.5 |
| Flow rate (ml) | 250 |
| Test time (h) | 72 |
| Catalyst | Copper, iron |

TABLE 4

| Classification | Friction ($\mu_d/\mu_s$) | Low-temp. viscosity (cP) | Oxidative stability (increase of total acid value: mg KOH/g) 24 hours | 48 hours | 72 hours |
|---|---|---|---|---|---|
| Example 1 | 0.981 | 19,900 | 0.20 | 0.34 | 1.11 |
| Example 2 | 0.992 | 22,000 | 0.17 | 0.29 | 1.05 |
| Example 3 | 0.984 | 24,400 | 0.15 | 0.26 | 1.01 |
| Example 4 | 1.003 | 38,760 | 0.24 | 0.39 | 1.29 |
| Comparative Example 1 | 0.996 | 44,530 | 0.42 | 0.89 | 2.75 |
| Comparative Example 2 | 0.016 | 43,200 | 0.43 | 1.01 | 2.98 |
| Comparative Example 3 | 0.987 | 46,700 | 0.38 | 0.50 | 2.50 |
| Comparative Example 4 | 1.024 | 48,060 | 0.36 | 0.46 | 2.42 |

*$\mu_d/\mu s$: Static and dynamic values ratio of single plate clutch friction characteristics From the above results, it is noted that the automatic transmission oil of this invention has several advantages in that compared to the conventional automatic transmission oil containing magnesium sulfonate or magnesium phenate as an antiabrasive agent, the automatic transmission oil of this invention has a similar or better friction property, higher oxidative stability and easier improvement for low-temperature property due to easiness in adjusting the viscosity of the automatic transmission oil.

What is claimed is:

1. Automatic transmission oil composition comprising the addition of an antioxidant, detergent dispersant, antiabrasive agent, anticorrosive agent, agent for adjusting a friction index, defoaming agent, viscosity index improver and colorant to a common lubricant oil, wherein one or more compounds selected from the following formula 1 and 2 as the antiabrasive agent is/are mixed with a compound expressed by formula 3 and the content ratio in the range of 0.01~5.0 wt %.

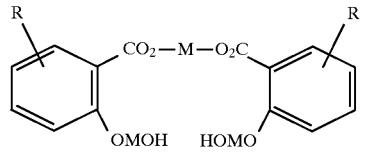

(1)

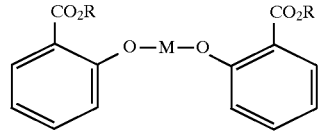

(2)

$MCO_3M(OH)_2$ (3)

Wherein,

R is a saturated or unsaturated $C_8$~$C_{100}$ aliphatic group;

M is a calcium, barium or magnesium atom.

2. The automatic transmission oil according to claim 1, wherein the compound of the formula 1 is one or more compounds selected from calcium 2-methylolalkylbenzoate, magnesium 2-methylolalkylbenzoate and barium 2-methylolalkylbenzoate.

3. The automatic transmission oil according to claim 1, wherein the compound of the formula 2 is one or more compounds selected from calcium alkylsalicylate, magnesium alkylsalicylate and barium alkylsalicylate.

4. The automatic transmission oil according to claim 1, wherein the compound of the formula 3 is one or more compounds selected from anhydrous calcium carbonate, anhydrous magnesium carbonate and anhydrous barium carbonate.

* * * * *